US010661121B2

(12) United States Patent
Robinik

(10) Patent No.: US 10,661,121 B2
(45) Date of Patent: May 26, 2020

(54) SWIM FIN

(71) Applicant: Maks Robinik, Miren (SI)

(72) Inventor: Maks Robinik, Miren (SI)

( * ) Notice: Subject to any disclaimer, the term of this patent is extended or adjusted under 35 U.S.C. 154(b) by 0 days.

(21) Appl. No.: 15/103,544

(22) PCT Filed: Dec. 16, 2014

(86) PCT No.: PCT/SI2014/000078
§ 371 (c)(1),
(2) Date: Jun. 10, 2016

(87) PCT Pub. No.: WO2015/094127
PCT Pub. Date: Jun. 25, 2015

(65) Prior Publication Data

US 2016/0287941 A1 Oct. 6, 2016

(30) Foreign Application Priority Data

Dec. 16, 2013 (SI) ..... 201300427

(51) Int. Cl.
*A63B 31/08* (2006.01)
*A63B 31/11* (2006.01)

(52) U.S. Cl.
CPC ..... *A63B 31/11* (2013.01)

(58) Field of Classification Search
CPC ..... A63B 31/08; A63B 31/10; A63B 31/11
(Continued)

(56) References Cited

U.S. PATENT DOCUMENTS 2,423,571 A 7/1947 Wilen
3,082,442 A * 3/1963 Cousteau ..... A63B 31/11 441/64

(Continued)

FOREIGN PATENT DOCUMENTS

DE 21 18 608 A1 10/1972
FR 2 455 905 A1 12/1980
GR 2009 0100 013 A 9/2010
SU 1313458 A1 * 5/1987 ..... A63B 31/16

* cited by examiner

*Primary Examiner* — Daniel V Venne
(74) *Attorney, Agent, or Firm* — Craft Chu PLLC; Andrew W. Chu

(57) ABSTRACT

The invention relates to the new structure of the fin or the fin's blade (2). The blade (2) is made of segments (S) and transitions (T), wherein a segment with a positive incline and a segment with a negative incline alternate along the blade (2). For example, two neighbouring segments (S) with a transition (T) can form the shape of a wave, a triangle, a trapezium or a tooth. Individual segments (S) can be flat, mainly flat or curved. The lengths of two neighbouring segments (S) with a transition (T) define total length (L). Heights (H) of segments (S), total length (L) and transition (T) length can be equal, they can increase or decrease linearly, progressively or regressively. Random combinations of changing shapes, heights (H), segments (S), total lengths (L) and transitions (T) along the blade (2) are possible. Segments can follow each other across the entire width of the blade's (2) surface or optionally in one part of the fin. Preferably, segments (S) are produced in the shape of waves with connective transitions, thus in the shape of a sinusoid. Preferably, the height (H1) of the segment is the highest at the root (7) of the blade (2), where the foot pocket (1) is installed, and decreases towards the ending (8) of the blade (2) until the transition to the flat part (10). Preferably, total lengths (L) are equal or increasing from the root (7) towards the ending (8) of the blade (2).

3 Claims, 6 Drawing Sheets

(58) Field of Classification Search
USPC ..... 441/60, 61, 64
See application file for complete search history.

(56) References Cited

U.S. PATENT DOCUMENTS

| | | | | |
|---|---|---|---|---|
| 3,178,738 | A | 4/1965 | La Trell | |
| 3,183,529 | A * | 5/1965 | Beuchat | A63B 31/11 441/64 |
| 4,775,343 | A | 10/1988 | Lamont et al. | |
| 5,387,145 | A * | 2/1995 | Wagner | A63B 31/11 441/64 |
| 5,702,277 | A * | 12/1997 | Wagner | A63B 31/11 441/64 |
| 6,413,133 | B1 * | 7/2002 | McCarthy | A63B 31/11 441/64 |
| 6,758,708 | B2 * | 7/2004 | Angelini | A63B 31/11 441/64 |
| 6,843,693 | B2 * | 1/2005 | McCarthy | A63B 31/11 441/64 |
| 7,865,268 | B2 * | 1/2011 | Valdivia y Alvarado | A01K 85/01 114/332 |
| 8,641,464 | B2 * | 2/2014 | Ortwig | A43B 5/08 441/64 |
| 9,364,717 | B2 * | 6/2016 | Davis | A63B 31/11 |
| 2002/0025744 | A1 * | 2/2002 | McCarthy | A63B 31/11 441/64 |
| 2004/0127117 | A1 * | 7/2004 | McCarthy | A63B 31/11 441/64 |
| 2006/0000137 | A1 * | 1/2006 | Valdivia y Alvarado | A01K 85/01 43/42.2 |
| 2008/0108259 | A1 * | 5/2008 | Melius | A63B 31/11 441/64 |
| 2010/0295417 | A1 * | 11/2010 | Wood | B25J 9/06 310/306 |

SWIM FIN

The invention relates to swim fins, mostly with the shape of the fins' blade.

The fins used today by professional divers are made of materials with a high elastic modulus. Carbon fibres covered with different polymeric materials such as epoxy or polyester are most commonly used. Materials with a high elastic modulus increase the efficiency of the fin. During use, the fin's blade is under a dynamic pulsating load, as the leg and the fin are moved up and down. Compressive and tensile force are alternately applied to the external surface of the blade longitudinally with the flow of the medium, i.e. water. Due to this alternating application of compressive and tensile force to the fin's blade as well as movement, the blade makes a noise similar to a click, which can be heard in the water. This noise is disturbing because it prevents the diver from soundlessly approaching fish, for example, if he wants to observe, photograph or catch them. The larger the elastic modulus of the material of the fin or the fin's blade, the louder the noise generated by the blade during regular use. The necessity to make a fin or a blade that would reduce or remove this noise therefore occurred. The problem was solved by creating a special shape of the fin's blade, which, longitudinally, has an alternating incline of the blade or the blade's surface, for example in the shape of a sinusoid with decreasing amplitude.

The development in the field of fins was mostly aimed at different structures of fins and different materials of which the fins are made, enabling higher efficiency of the fin, the force, which should be applied by the user to maximize the effect of his work. The EP 2055353 patent application therefore describes the structure of the fin, which has two side parts extending along the entire length of the fin from the foot pocket, i.e. along the entire blade. The blade is attached to these side parts only in two spots, in the upper part, where the foot pocket extends into the blade, and towards the end of the blade. In the central part, the blade is flexible in the transverse up and down direction. The US 2012/0289105 patent application describes the structure of the fin, whose central part of the blade is attached to some kind of hinges at the end of the fin enabling the undulation of the fin in the transverse up-down direction, while a membrane limiting the movement of the blade is attached to the flexible blade along the left and right edge of the fin in the longitudinal direction.

Since 1990, when first carbon-fibre fins creating noise during regular use appeared, people have been dealing with the problem of removing or limiting this noise. The purpose and objective of the invention is to remove the noise, the click, in dynamically loaded blades made of materials with a high elastic modulus.

The invention solves the said technical problem by creating a new shape of the blade. Due to its special shape, the blade or its surface, otherwise creating noise under dynamic pulsating load, is prevented from generating such surface tension, which would create noise or clicks.

In fins made of materials with a high elastic modulus, different thermoplastic or composite materials such as carbon, glass and other fibres covered with various polymeric materials, based on the state of the art, the blade is flat or mainly flat, while the entire surface is levelled or mainly levelled. During regular use of the fins, when the user is swimming with up and down strokes, compressive and tensile force are alternately applied to the surface of the blade longitudinally with the flow of the medium. When the blade is bent downwards, tensile force is applied to its external surface, i.e. the side turned towards the water surface during swimming, while compressive force is applied to the inner surface of the blade, i.e. the side turned towards the bottom during swimming. When the blade is bent upwards, the forces are interchanged. Tensile force is replaced by compressive force and vice-versa.

In ideal circumstances, which are never achieved, there would be no noise or click, the surface of the blade would be perfectly smooth, the blade would be completely rigid in the transverse direction, the distribution of forces on the blade under a load, when the user is swimming with up and down strokes, would be completely equal in the transverse direction, thus the force exchange from compressive to tensile force would be connective and not instantaneous. Due to the above-mentioned reasons, random surface parts, bent in the opposite direction as they should be according to the application of compressive and tensile forces to this part of the surface in the given moment, could not be generated on the surface of the blade.

In reality, the surface of the blade is not perfectly smooth, the blade is not completely rigid in the transverse direction and during use, when the user is swimming with up and down strokes, the blade is under dynamic load causing the local formation of areas with different force combinations. Consequently, random locally defined areas with opposite camber according to the forces applied to that part of the blade's surface in that moment, appear on the surface of the blade. This means that parts of the blade's surface bend concavely or convexly, in the opposite direction as they should according to the current application of tensile or compressive force to the surface of the blade. For example, the part of the surface should be bent concavely according to the forces, but it is bent convexly or vice-versa. Due to the application of tensile or compressive force, the camber of this part of the surface changes instantaneously, which creates noise: a click. The number of these random locally defined surfaces of the blade and the camber level, as well as the loudness of the noise or click are affected by the basic structure of the blade, i.e. its flatness, the flexibility of the material, the medium in which the fin is used, being mostly commonly water, and other factors.

If the blade of the fin changes in terms of its structure, the blade being produced in a form which enables all three dimensions and increased rigidity in the transverse direction of the blade, random local surfaces on the blade with reverse camber are reduced or even completely disabled, which minimises or removes the noise or click.

The invention is described by using examples and drawings

FIG. 1 is a schematic view of a structure of the fin based on the state of the art.

FIG. 2A includes schematic views of different segment shapes with and without transitions and ground plan of the fin.

Figure 1:
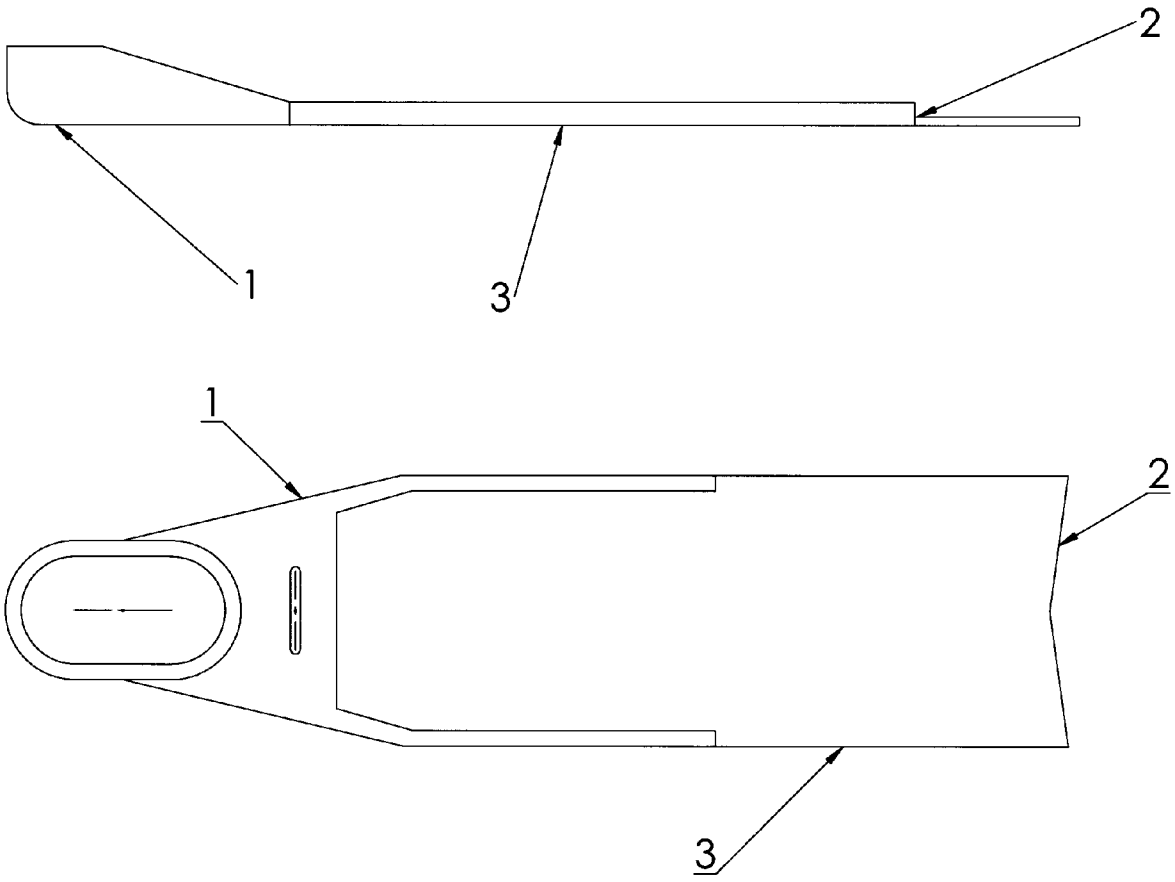

FIG. 1 shows the fin based on the state of the prior art. It consists of foot pocket 1 and blade 2. Foot pocket 1 can be made of rubber or various thermoplastic materials. Blade 2 is usually made of different thermoplastic or composite materials such as carbon, glass or other fibers. Side 3 can be rubber-coated across the entire length. Wings, which are not shown in the drawing, can be made or attached sideways to stabilize the fins. The rubber profile prevents the water from leaking sideways and also stabilizes the movement of the fin in the direction of swimming.

According to the present invention, and with reference to FIGS. 2 through 5, the blade is made of a plurality of segments (S) and a plurality of transitions (T), which follow each other along the length of blade 2, while the inclines of individual-S segments, S, according to the longitudinal axis of the fin are alternately changing. If the initial segment S1 at root 7 has an increasing incline, the following segment S2 has a decreasing incline, the third segment S3 an increasing one again and so on (i.e., in a repeating fashion). The initial segment S1 can also have a decreasing incline, which means the following segment S2 has an increasing incline, the third segment S3 has a decreasing one. This repeats along the length thereof. The segment inclines in the longitudinal direction of the blade can therefore follow each other randomly, but the segment with an increasing incline must always be followed by a segment with a decreasing incline and vice-versa. In other words, they alternate up and down.

Figure 2A:
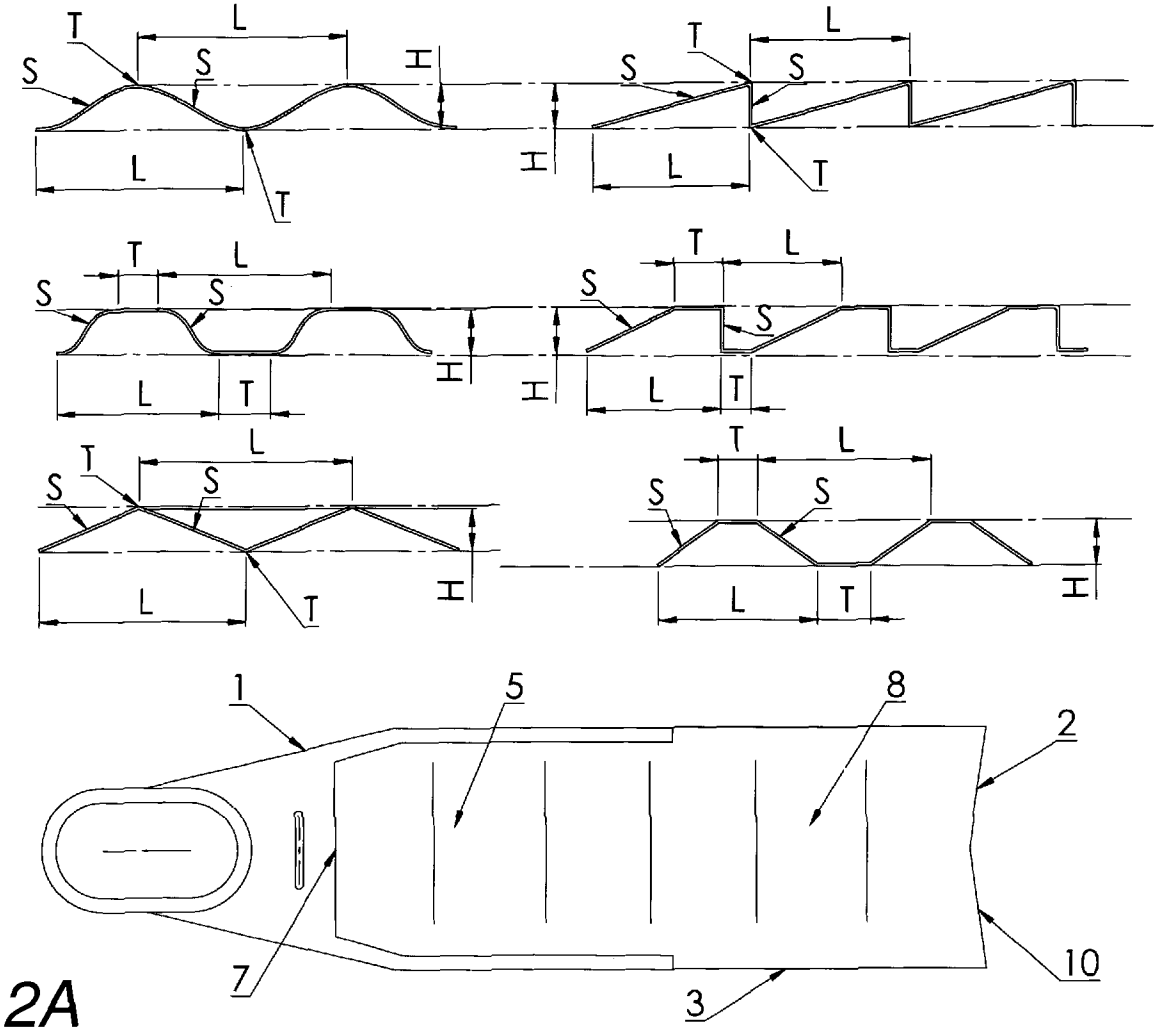
FIG. 2B is a side schematic view of the fin.
Figure 2B:
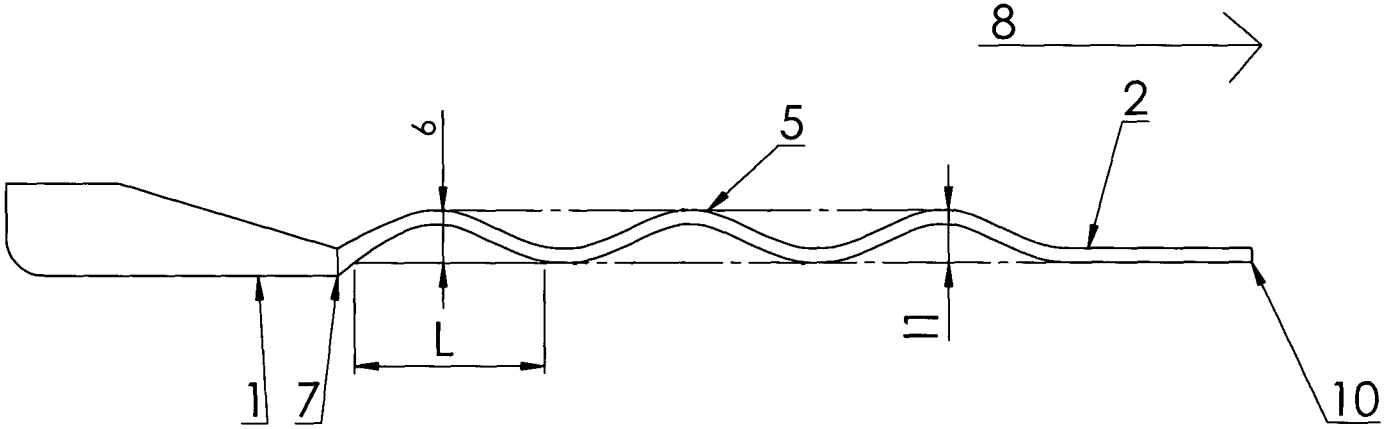

The transition T from one segment S with an increasing incline to another segment S with a decreasing incline or vice-versa may take a variety of different forms. For example, the transition T can be connective, as in a sinusoid, or it can include a transitional part, which may be flat or curved, or a break in the spot between two inclines. For example, two neighboring segments S with a transition T can form the shape of a wave, a triangle, a trapezium or a tooth. Individual segments S can be flat, mainly flat or curved. Different examples of possible segment forms S are shown in FIG. 2A and FIG. 2B. The lengths of two neighboring Segments S with a Transition T define the total length L. Transitions in the drawing of the fin in FIG. 2A and FIG. 2B are marked with the reference number 5. In FIG. 2B, the height of a segment is marked with 11. H heights of Segments S, total L length and Transition T lengths can be equal, they can increase or decrease linearly, progressively or regressively. Random combinations of changing shapes, H heights of Segments S, total L lengths and transitions T along blade 2 are possible.

According to the invention, and with reference to FIGS. 2/2 to 5, blade 2 includes at least three segments S (first segment S1, second segment S2, and third segment S3). The first height H1 of the first segment is the highest at root 7 at the proximal end 2A of the blade 2, where foot pocket 1 is installed. The second height H2 decreases or is smaller than the first height H1 and is positioned more towards ending 8 of blade 2 than the first height H1. The third height H3 decreases or is smaller than the second height H2 and is positioned more towards the ending 8 of the blade 2 than the second height H2. Therefore, H1>H2>H3, etc., until components of the blade reach the flat part 10. The total lengths L of two neighboring segments are equal or increasing from root 7 towards ending 8 of blade 2. The first total length L1 is the shortest at root 7 of blade 2. The second total length L2 increases or is larger than the first total length L1 and is positioned more towards ending 8 of blade 2. The third total length L3 increases or is larger than the second total length L2 and is positioned more towards ending 8 of the blade 2. Therefore, L1>L2>L3, etc. Preferably, the lengths of transitions T are equal or increasing from root 7 towards ending 8 of blade 2. The first total length L1 of the straight first transition, the first segment S1 and the second segment S2 is the shortest of the first total length L1, the second total length L2, and the third total length L3, at root 7 of blade 2. The second total length L2 of the second segment S2, the straight second transition T2, and the third segment S3 towards ending 8 of blade 2 is longer than the first total length L1. Therefore, T1<T2<T3, etc. Segments S can be produced preferably across the entire width of blade 2 or optionally in one part of the fin. The most preferably, segments S are produced in the shape of waves with connective transitions, thus in the shape of a sinusoid.

The velocity of water outflow in the fin is the highest at the end of the blade, this is why the height of each successive segment decreases along the blade, which reduces turbulence. The heights corresponding to the first segment, the second segment, and the third segment, also increases the rigidity of the blade mostly in the transverse direction, which has a positive impact on the overall function of the fin. Increased torsional resistance of the fin leads to better control of the fin during use.

During the construction of the fins, the desired hardness or rigidity of the fins is established based on tests. This is why an the relationships between the heights (H1, H2, H3) and lengths (L1, L2, L3) corresponding to the first segment S1, second segment S2, and third segment S3, enable the removal of noise or click, suitably increasing the rigidity of the fin and also having a minimum impact on the user's increased power intake to achieve equal action as if the blade was flat. It is desirable that the ratio between H height of the S segment and total L length at root 7 of blade 2 is between 0.15 and 0.015 and then decreases towards 0 until the transition to flat part 10.

Preferably, the highest height H1 of the segment S is between 2.5 and 5 mm, while the total length L is between 4 and 6 cm. The number of Segments S depends on the fin's length. That is, the longer the fin, the more segments S that will be included With an imposed blade form created in line with the invention, areas bent concavely or convexly on the surface of the blade are accurately defined. It has been found that with the present invention, random reverse camber of the blade's surface according to the force currently applied to the entire surface of the blade is less likely or even prevented as compared to the prior art. With the present invention, the surface of the blade is pre-stressed and does not include straight sections. As such, the rigidity of the blade is increased in the transverse direction, which minimises or removes the noise or click that is otherwise created.

The invention will be presented in detail using the examples.

Figure 3:
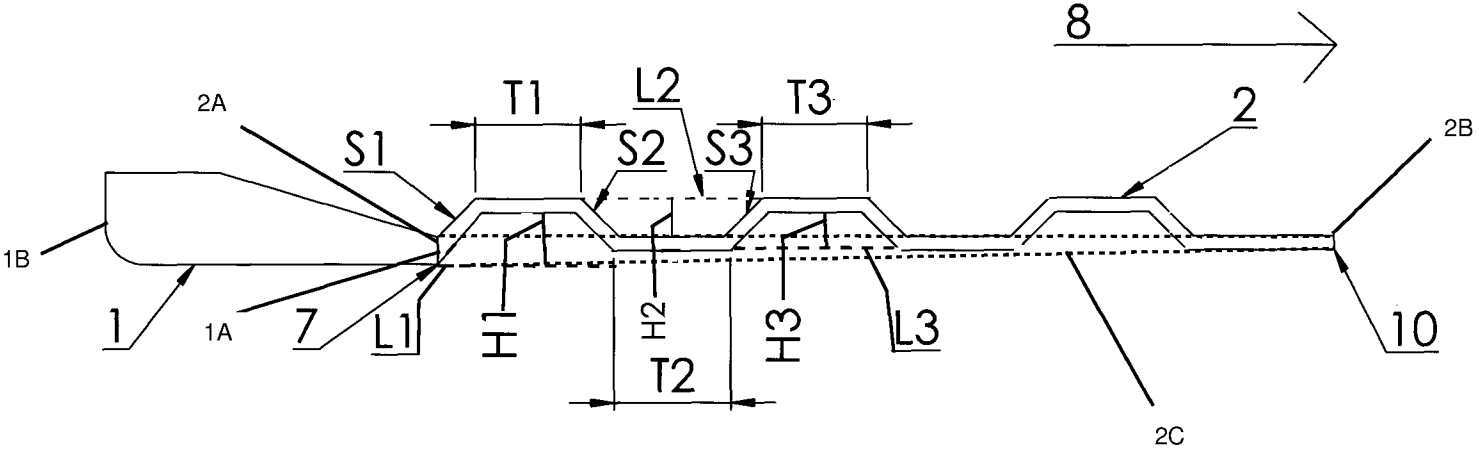
FIG. 3 is a schematic view of an example of a blade with triangular segments and straight transitions.

FIG. 3 shows an example of blade 2 with triangular segments S (first segment S1, second segment S2, and third segment S3) and straight transitions T (first transition T1, second transition T2, and third transition T3).

The fin 100 consists of foot pocket 1 having a front end 1A and a back end 1B and blade 2 having a proximal end 2A and a distal end 2*b*. Two neighboring segments S form the shape of a triangle with a straight transition T. The blade 2 near foot pocket 1 begins with the first segment S1 and increasing incline continuing into the second segment S2 with a decreasing incline through straight first transition T1 and then continuing into the third segment S3 with an increasing incline through straight second transition T2 and so on until the transition to flat part 10, which closes blade 2 so as to define a blade plane between the root to the flat part. The segments follow each other in the longitudinal direction towards ending 8 of blade 2 across the entire surface of blade 2. The first height H1 of the first segment S1 is the highest at root 7 at the proximal end 2A of blade 2, where foot pocket 1 is installed. The second height H2 decreases towards ending 8 of blade 2, and the third height H3 decreases towards the ending 8 of the blade 2. Therefore, H1>H2>H3 and so forth until the flat part 10 is reached. The first total length L1 is the shortest at root 7 of blade 2. The second total length L2 increases towards ending 8 of blade 2, the third total length L3 increases towards ending 8 of the blade 2. Therefore, L1<L2<L3 and so forth until the flat part is reached. The first total length L1 of the straight first transition, the first segment S1 and the second segment S2 is the shortest of the first total length L1, the second total length L2, and the third total length L3, at root 7 of blade 2. The second total length L2 of the second segment S2, the straight second transition T2, and the third segment S3 towards ending 8 of blade 2 is longer than the first total length L1. Therefore, T1<T2<T3.

Figure 4:
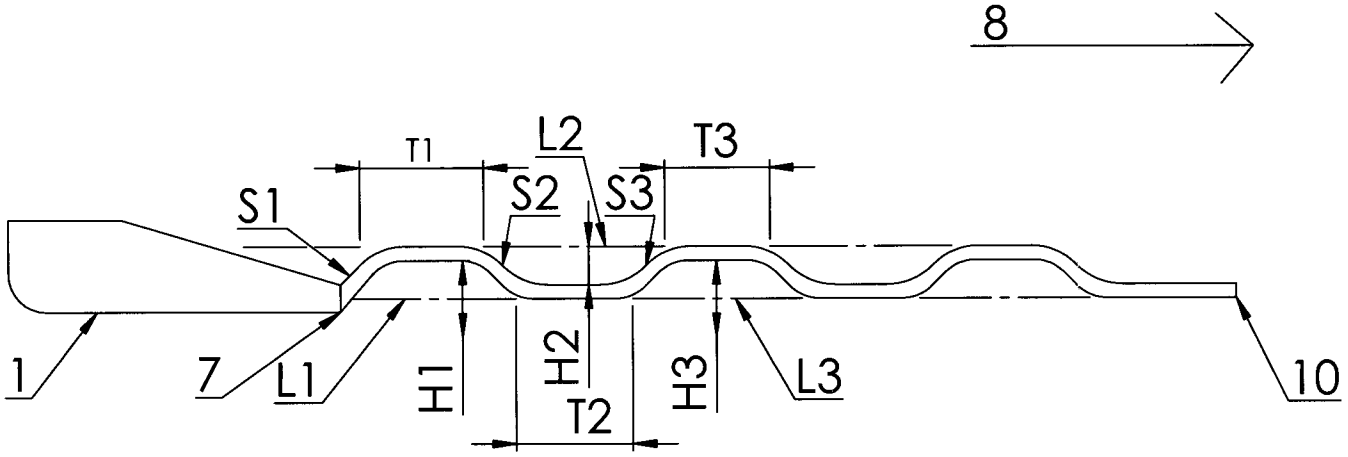
FIG. 4 is a schematic view of an example of a blade with wave-shaped segments and straight transitions

FIG. 4 shows an example of blade 2 with wave-shaped Segments S and straight Transitions T.

The fin consists of foot pocket 1 and blade 2. Two neighboring Segments S form the shape of a wave with a straight transition T while blade 2 near foot pocket 1 begins with the segment S1 and increasing incline continuing into the segment S2 with a decreasing incline through straight Transition T and then continuing into the segment S3 with an increasing incline through straight Transition T and so on until the transition to flat part 10, which closes blade 2. The segments follow each other in the longitudinal direction towards ending 8 across the entire surface of blade 2. Height H1 of the segment is the highest at root 7 of blade 2, where foot pocket 1 is installed, and decreases towards ending 8 of blade 2, therefore H1>H2>H3 and so forth until the flat part is reached. The total length L1 is the shortest at root 7 of blade 2 and increases towards ending 8 of blade 2, therefore L1<L2<L3 and so forth until the flat part is reached. The length of the straight transition is the shortest at root 7 of blade 2 and increases towards ending 8 of blade 2, therefore T1<T2<T3.

Figure 5:
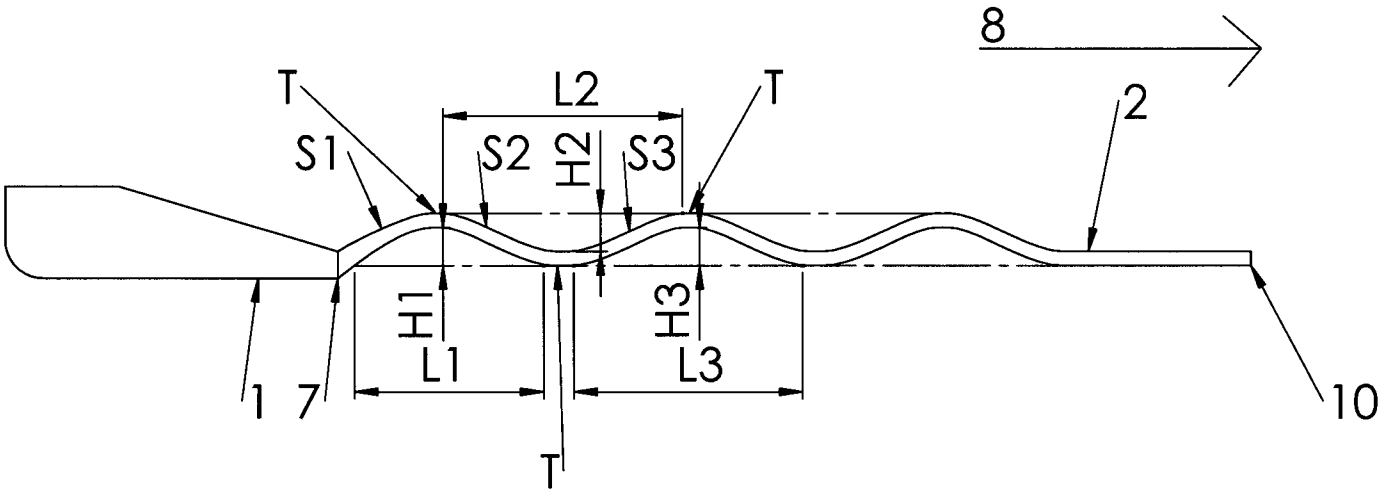
FIG. 5 is a schematic view of an example of the most preferable blade with wave-shaped segments and connective transitions, in the shape of a sinusoid.

FIG. 5 shows an example of the most preferable blade 2 with wave-shaped Segments S and connective transitions, in the shape of a sinusoid.

The fin consists of foot pocket 1 and blade 2. Two pairs of neighboring Segments S form a wave. Blade 2 is made of wave-shaped Segments S with connective Transitions T, while the waves form a sinusoid. Blade 2 begins near foot pocket 1 with the segment S1 and increasing incline connectively continuing into the segment S2 with a decreasing incline and then continuing into the segment S3 with an increasing incline and so on until the transition to flat part 10, which closes blade 2. The waves or segments follow each other in the longitudinal direction towards ending 8 of blade 2 across the entire surface of blade 2. Height H1 of the segment is the highest at root 7 of blade 2, where foot pocket 1 is installed, and decreases towards ending 8 of blade 2, therefore H1>H2>H3 and so forth until the flat part is reached. The total length does not change and is constant across the entire length of blade 2, therefore L1=L2=L3 and so forth until the flat part is reached.

The shown examples do not limit the use of other segment forms regarding length, height and shape.

The invention claimed is:

1. A swim fin, comprising:

a foot pocket having a front end and a back end; and a blade having a proximal end and a distal end and being comprised of a root at said proximal end and adjacent to said front end of said foot pocket and a flat part at said distal end and extended away from said foot pocket, said blade having a blade plane between said root and said flat part, wherein said blade further comprises:

a first segment being inclined in a first direction relative to said blade plane and having a first height;

a first transition connected to said first segment, said first segment being between said first transition and said root;

a second segment being inclined in a second direction relative to said blade plane and having a second height, said second direction being opposite said first direction, said first segment being positioned between said second segment and said root of said blade;

a second transition connected to said second segment, said second segment being between said first transition and said second transition, said second transition being longer than said first transition;

a third segment being inclined in a third direction relative to said blade plane and having a third height, said third direction being opposite said second direction, said third segment being positioned between said second segment and said flat part of said blade; and a third transition connected to said third segment, said third segment being between said second transition and said third transition, said third transition being longer than said second transition, wherein said first segment, said first transition and said second segment define a first total length, wherein said second segment, said second transition and said third segment define a second total length, wherein said third segment and said second transition define a third total length, and wherein said first height is greater than said second height, said second height being greater than said third height, said second total length being greater than said first total length, said third total length being greater than said second total length, so as to remove clicking noise by increasing rigidity and maintain power to be actuated as a flat blade.

2. The swim fin, according to claim 1, wherein a first ratio of said first height to said first total length ranges between 0.15 and 0.015, wherein a second ratio of said second height to said second total length less than said first ratio, and wherein a third ratio of said third height to said third total length is less than said second ratio.

3. The swim fin, according to claim 1, wherein said blade is comprised of composite material.

* * * * *